US006319659B1

(12) United States Patent
Taima

(10) Patent No.: US 6,319,659 B1
(45) Date of Patent: Nov. 20, 2001

(54) SILVER HALIDE EMULSION, PREPARATION METHOD THEREOF AND SILVER HALIDE PHOTOGRAPHIC LIGHT SENSITIVE MATERIAL

(75) Inventor: Yasuo Taima, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/398,363

(22) Filed: Sep. 17, 1999

(30) Foreign Application Priority Data

Oct. 13, 1998 (JP) ..... 10-290591

(51) Int. Cl.[7] ..... G03C 1/005
(52) U.S. Cl. ..... 430/569; 430/567
(58) Field of Search ..... 430/567, 569

(56) References Cited

U.S. PATENT DOCUMENTS 4,334,012 * 6/1982 Mignot ..... 430/567
5,482,826 * 1/1996 Okamura et al. ..... 430/569
5,525,460 * 6/1996 Maruyama et al. ..... 430/567
5,527,664 * 6/1996 Kikuchi et al. ..... 430/569
5,580,713 * 12/1996 Hara et al. ..... 430/607
5,972,588 * 10/1999 Nabeta ..... 430/567
5,985,534 * 11/1999 Maruyama ..... 430/567

FOREIGN PATENT DOCUMENTS 0843208 5/1998 (EP) .
0911687 4/1999 (EP) .
10-123646 * 5/1998 (JP) .

OTHER PUBLICATIONS

European Search Report EP 99 30 7414 Feb. 11, 2000.

* cited by examiner

*Primary Examiner*—Janet Baxter
*Assistant Examiner*—Amanda C. Walke
(74) *Attorney, Agent, or Firm*—Jordan B. Bierman; Bierman, Muserlian and Lucas

(57) ABSTRACT

A method for preparing a silver halide emulsion comprising silver halide grains is disclosed, comprising: reacting a silver salt solution and a halide salt solution to perform silver halide grain nucleation, followed by silver halide grain growth to form the silver halide grains, wherein the silver halide grains are formed in the presence of an iodide ion releasing agent; and subjecting a reaction mixture solution to ultrafiltration during grain growth.

2 Claims, 1 Drawing Sheet

SILVER HALIDE EMULSION, PREPARATION METHOD THEREOF AND SILVER HALIDE PHOTOGRAPHIC LIGHT SENSITIVE MATERIAL

FIELD OF THE INVENTION

The present invention relates to silver halide photographic light sensitive materials, and in particular to silver halide emulsions exhibiting improved photographic performance, a preparation method thereof and silver halide photographic light sensitive materials.

BACKGROUND OF THE INVENTION

Basic techniques of silver halide emulsions to achieve enhancement of sensitivity and image quality of silver halide photographic light sensitive materials include enhancements of monodispersibility of a silver halide grain emulsion. Optimum conditions for chemical sensitization of a silver halide emulsion depend partly on the size of silver halide grains, so that it is rather difficult to achieve optimal chemical sensitization of a polydisperse silver halide emulsion (having a broad grain size distribution), which often leads to increased fogging or insufficient chemical sensitization. On the other hand, it is easy to provide optimal chemical sensitization to a monodisperse silver halide grain emulsion, leading to a silver halide emulsion with enhanced sensitivity and low fogging. A monodisperse emulsion results in a photographic material with high contrast.

Preparation of silver bromide or silver iodobromide grains having two parallel twin planes employs the Ostwald ripening process, wherein only nucleus grains produced at the initial stage of nucleation, which have two parallel twin planes nucleus grain and growth activity in its side-faces, selectively retained by receiving solutes which resulted from dissolution of regular crystal grains. The nucleus grains are allowed to grow by the double jet addition of silver nitrate and halide solutions at a relatively high pBr, with maintaining or narrowing the size distribution of the nucleus grains. However, excessive Ostwald ripening increases the number of nucleus grains and at the same time tends to cause deterioration in homogeneity of nucleus grain size distribution. Therefore, to prepare tabular grains with highly narrow size distribution, it is desirable to narrow the size distribution at the stage of forming the tabular nucleus grains.

There have been disclosed techniques regarding monodisperse tabular silver halide grains, for example, JP-A 1-213637 (herein, the term, JP-A means unexamined and published Japanese Patent Application) discloses a technique of improving sensitivity and graininess by using monodisperse silver halide grains having two parallel twin planes. JP-A 5-173268 and 6-202258 disclose a method for preparing tabular silver halide grains with narrow grain size distribution. These techniques are directed to monodisperse tabular silver halide grains with a small variation in the area-equivalent grain diameter.

Tabular grain size is generally defined in terms of two parameters. The first parameter is an area-converted grain diameter and the other one is a grain thickness. Thus, the size distribution of tabular grains cannot be achieved, even if only the area-converted grain diameter distribution of tabular grains is narrowed. Broad size distribution of tabular grains produces problems such as fluctuation in sensitivity deterioration in graininess due to difference in developability.

JP-A 6-258744 teaches a technique for improving pressure resistance and latent image stability as well as enhanced sensitivity and contrast by using monodisperse tabular silver halide grains with an aspect ratio of 2 or more and having internal portions different in halide composition, wherein the monodisperse silver halide grains means those having a small fluctuation in the volume-converted grain diameter. However, this technique does not include anything with respect to the manufacturing cost of the tabular silver halide grain emulsion.

JP-A 5-210188 discloses a technique of forming core grains containing 10 to 45 mol % iodide while maintaining 0.1 to 3.0 $\mu$m of the intergrain distance. However, this technique suggests neither intention of controlling the mean intergrain distance in the process of grain growth nor means therefor.

Development of silver halide emulsions including a tabular silver halide grain emulsion is associated with problems regarding manufacturing costs as well as photographic performance. An effective method for controlling the manufacturing cost is to increase the emulsion-manufacturing amount per run. In other words, this means to increase the yield of silver halide at the time when completing grain growth in the reaction vessel used for manufacturing silver halide emulsions. Thus, it is to enhance the silver halide concentration of the emulsion at the completion of grain growth and a direct method is to concentrate a silver halide emulsion or reduce the volume of the emulsion. JP-B 59-43727 (herein, the term JP-B means examined and published Japanese Patent) and JP-A 3-140946 disclose techniques of using ultrafiltration to reduce the volume of reaction product (i.e. a silver halide emulsion) in the process of preparing emulsions. However, these disclosures do not include any suggestion with respect to tabular grains nor monodisperse tabular grain emulsions. Further, these techniques were not intended to control the mean intergrain distance of silver halide grains in the preparation of silver halide emulsions.

JP-A 6-67326 discloses a method in which ultrafiltration is applied to the preparation of tabular silver halide grain emulsions to reduce the reaction product volume to obtain tabular grains with medium aspect ratios (i.e., 2 to 8), together with an enhanced yield. According to the disclosure, employing the aspect ratio of silver halide grains systemtically decreasing with the concentration, tabular grains with a medium aspect ratio were obtained by concentrating a high aspect ratio tabular grain emulsion through the ultrafiltration in the course of the preparation thereof. However, the higher the aspect ratio is, it is generally difficult to enhance homogeneity of the tabular grains, so that it cannot be expected to achieve a sufficient improvement in the grain size distribution by the method of reducing the aspect ratio through concentration of a tabular grain emulsion with high aspect ratio. In fact, silver halide emulsions described in the disclosure, including comparative and inventive emulsions, exhibited 0.3 or more of a coefficient of variation of volume-converted diameter, therefore, it is insufficient to solve problems associated with photograpic performance of tabular grains. Moreover, the disclosure does not teach about any apparatus for preparing the silver halide emulsions.

There have been proposals of enhancing the sensitivity of silver halide emulsions. Specifically, there is known a technique of introducing iodide into the silver halide grain surface to promote adsorption of a spectral sensitizing dye. Disclosed as a method for introducing iodide into the grain surface are addition of potassium iodide to an emulsion to cause halide conversion, simultaneous addition of silver nitrate and potassium iodide solutions, as described in JP-A 4-107442 and addition of a fine silver iodide grain emulsion. JP-A 2-68538 and 5-323487 disclose a technique of forming silver halide grains by the use of an iodide ion releasing agent. However, the iodide ion releasing agent, which releases an iodide ion upon reaction with a base or a nucleophilic agent, produced problems such that a by-product or an unreacted iodide ion releasing agent remain in the reaction mixture, leading to deterioration in homogeneity of the iodide distribution among the grains.

SUMMARY OF THE INVENTION

Accordingly, a n object of the present invention is to provide a silver halide emulsion which is superior in homogeneity of grain size distribution, aspect ratio distribution and iodide content distribution amoung grains; a preparation method of the emulsion and a silver halide photographic light sensitive material.

The object of the present invention can be accomplished by the following constitution:

1. A method for preparing a silver halide emulsion comprising silver halide grains, comprising:

(a) reacting a silver salt solution and a halide salt solution to perform silver halide grain nucleation, followed by silver halide grain growth to form the silver halide grains, wherein the silver halide grains are formed in the presence of an iodide ion releasing agent, and (b) subjecting a reaction mixture solution to ultrafiltration during grain growth.

Figure 1:
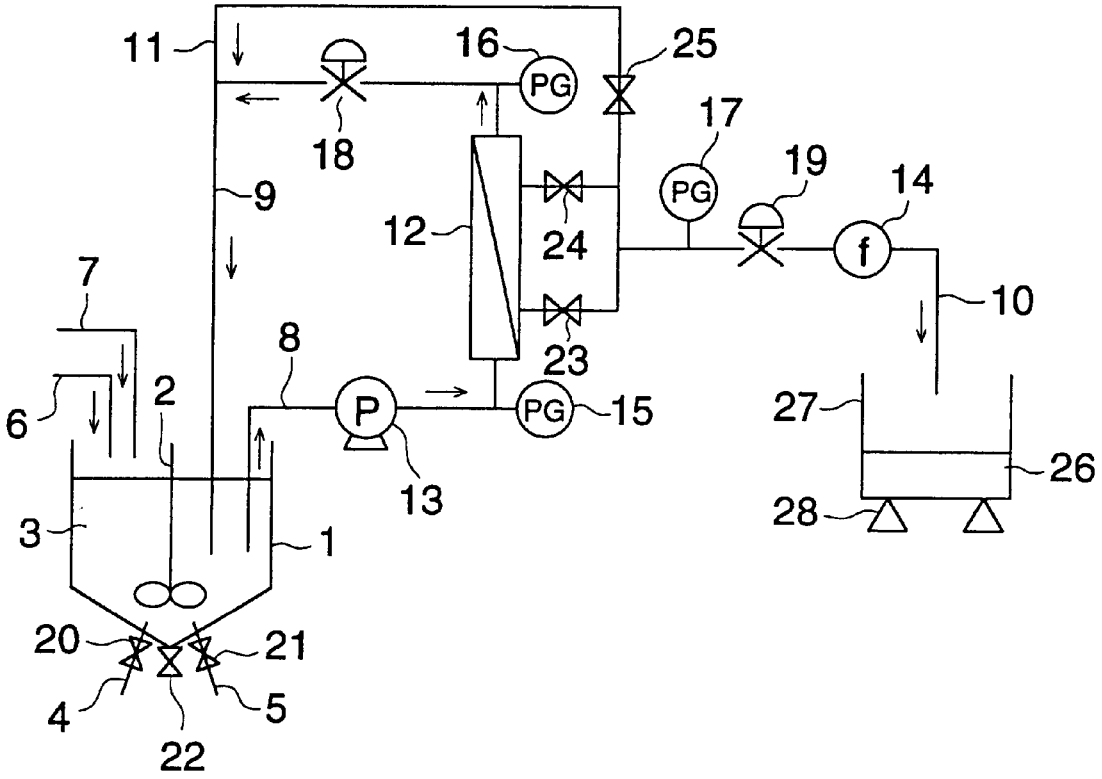
FIG. 1 illustrates an apparatus for preparing silver halide emulsions, which is applicable to the invention.

Explanation of Numerals:

1 Reaction vessel
2 Stirring mechanism
3 Dispersing medium
4 Silver addition line
5 Halide addition line
6 Dispersing medium addition line
7 Addition line
8 Solution with drawing line
9 Solution returning line
10 Permeating solution draining line
11 Permeating solution returning line
12 Ultrafiltration unit
13 Circulation pump
14 Flow-meter
15, 16, 17 Pressure gauge
18 Pressure adjusting valve
19 Flow rate adjusting valve
20 Silver addition valve
21 Halide addition valve
22 Solution withdrawing valve
23, 24, 25 Valve
26 Ultrafiltration permeating solution
27 Permeating solution receiver
28 Balance

DETAILED DESCRIPTION OF THE INVENTION

According to the present invention, optimal removal of a solution containing soluble salts through ultrafiltration also removes by-products of the iodide ion releasing agent or unreacted iodide ion releasing agent from the reaction mixture to enable preparing a silver halide emulsion containing no impurity, resulting in reduced variation of the iodide content among grains and leading to accomplishment of development of silver halide emulsions with low fogging, high sensitivity and high contrast.

The iodide contained in the surface of silver halide grains is preferably formed by iodide ions supplied from an iodide ion releasing agent described below. Thus, the iodide ion releasing agent is represented by the following formula (1):

$$R—I \qquad \text{Formula (1)}$$

wherein R represents a univalent organic acid residue capable of releasing an iodide ion upon reaction with a base and/or a nucleophilic agent.

Preferred examples of R include an alkyl group having 1 to 30 carbon atoms, an alkenyl group having 2 to 30 carbon atoms, an aryl group having 6 to 30 carbon atoms, an aralkyl group having 7 to 30 carbon atoms, a heterocyclic group, an acyl group having 2 to 30 carbon atoms, a carbamoyl group, an alkyl- or aryl-sulfonyl group and an alkyl- or aryl-sulfamoyl group. Specifically, the carbon number of R is preferably 12 or less. Of these is preferred an alkyl group. The R described above is preferably further substituted. Exemplary preferred substituents include a halogen atom (e.g., fluorine, chlorine, bromine, iodine), an alkyl group (e.g., methyl, ethyl, n-propyl, i-propyl, t-butyl, n-octyl, cyclopentyl, cyclohexyl), alkenyl group (e.g., allyl, 2-butenyl, 3-pentenyl), alkynyl group (e.g., propargyl, 3-pentynyl), aralkyl group (e.g., benzyl, phenethyl), aryl group (e.g., phenyl, naphthyl, 4-methylphenyl), heterocyclic group (e.g., pyridyl, furyl, imidazolyl, piperidyl, morphoryl), alkoxy group (e.g., methoxy, ethoxy, butoxy), aryloxy group (e.g., phenoxy, naphthoxy), amino group (e.g., unsubstituted amino, dimethylamino, ethylamino, anilino), acylamino group (e.g., acetylamino, benzoylamino9, ureido group (e.g., unsubstituted ureido, N-methylureido, N-phenylureido), urethane group (e.g., methoxycarbonylamino, phenoxycarbonylamino), ulfonylamino group(e.g., methylsulfonylamino, phenylsulfonylamino), sulfamoyl group (e.g., sulfamoyl, N-methylsulfamoyl, N-phenylsulfamoyl), carbamoyl group (e.g., carbamoyl, diethylcarbamoyl, phenylcarbamoyl), sulfonyl group (e.g., methylsulfonyl, benzenesulfonyl), sulfinyl group (e.g., methylsulfinyl, phenylsulfinyl), alkyloxycarbonyl group (e.g., methyoxycarbonyl, ethoxycarbonyl), aryloxycarbonyl group (e.g., phenoxycarbonyl), acyl group (e.g., acetyl, benzoyl, formyl, pivaroyl), acyloxy group (e.g., acetoxy, benzoyloxy), phosphoric acid amide group (e.g., N,N-diethylphosphoric acid amide), alkylthio group (e.g., methylthio, ethylthio), arylthio group (e.g., phenylthio), cyano, sulfo group, carboxy group, hydroxy, phosphono group and nitro. Of these substituents are preferred a halogen atom, alkyl group, aryl group, 5- or 6-membered heterocyclic group containing at least one of oxygen, nitrogen and sulfur atoms, alkoxy group, aryloxy group, acylamino group, sulfamoyl group, alkylsulfonyl group, arylsulfonyl group, aryloxycarbonyl group, acyl group, sulfo group, carboxy group, hydroxy, or nitro. Specifically more preferred substituents attached to an alkyl group are hydroxy, carbamoyl group and lower alkylsulfonyl group (including its salt), which preferably has one to four carbon atoms; and preferred substituent attached to a phenyl group is a sulfo group (including its salt).

The iodide ion releasing compound splits off an iodide ion upon reaction with a base or a nucleophilic agent, wherein the iodide ion may be an iodide ion or an iodide ion attached to an organic group. The iodide ion releasing compounds can readily be synthesized by reference to J. Am. Chem. Soc., 76, 3227–8 (1954); J. Org. Chem., 16, 798 (1951); Chem. Ber., 97, 390 (1964); Org. Synth., 1955, 1383; and Chem. Commu., 1971, 1112.

The compounds described above release iodide ions, upon reaction with an iodide ion release-adjusting agent. The iodide ion release-adjusting agent includes bases and nucleophilic agents. Preferred examples thereof include hydroxide ion, sulfite ion, hydroxyamine, thiosulfate ion, metabisulfite ion, mercaptans, sulfinate, carboxylate, ammonia, amine, alcohols, ureas, thioureas, phenols, hydrazines, hydrazides, and sulfides. Of these, hydroxise ion, sulfite ion, hydroxylamine, thiosulfate ion, and metabisulfite ion are preferred and hydroxide ion and sulfite ion are more preferred.

The iodide ion releasing rate and timing can be controlled by controlling the concentration of a base or nucleophilic agent, an addition method or the reaction solution temperature.

The iodide ion releasing compound is added preferably in an amount of $1\times10^{-5}$ to $1\times10^{-2}$ mol, and more preferably $1\times10^{-5}$ to $1\times10^{-4}$ mol per mol of silver halide. Preferred temperature range to control the iodide ion releasing rate and timing is 30 to 80° C. and more preferably 35 to 60° C. At a high temperature of more than 80° C., the iodide ion releasing rate is generally too high, and at a low temperature of less than 30° C., the releasing rate is too low. Either case is not preferred. When using a base for iodide ion releasing, the pH of the reaction solution may be varied. The preferred pH range is 2 to 12, and more preferably 5 to 10. The base and the nucleophilic agent may be used alone or in combination, in which the pH is controlled within the range described above to control the iodide ion releasing rate and timing.

In cases where the iodide ion releasing compound contains two or more iodide ions to be released, all of the iodide ions may be released or a part of them may remain without being released. The iodide ion releasing rate can be determined by controlling the temperature, the pH and concentrations of the iodide ion releasing compound, base and nucleophilic agent, and therefore, the rate can optionally be selected. The control of the concentration of iodide ions to be released is preferably made in the following manner. Thus, after the iodide ion releasing compound is added into a reaction solution and uniformly mixed, the pH, the concentration of a nucleophilic agent or the temperature is varied and conventionally, the pH is gradually varied from a low pH to a high pH to uniformly control the iodide ion of the overall reaction solution. The iodide ion releasing agent may be added at any time during grain formation, and is preferably added during the grain growth. The iodide ion release-adjusting agent may be added at any time after adding the iodide ion releasing agent, preferably during grain growth, and more preferably immediately before or at the time of completing the grain growth. Further, the iodide ion releasing agent and iodide ion release-adjusting agent is added preferably immediately before or at the time of completing grain growth.

Exemplary examples of the compound represented by formula (1) are showm below, but the present invention is not limited to these examples.

(1) $ICH_2COOH$
(2) $ICH_2CONH_2$
(3) $ICH_2CN$
(4) $I(CH_2)_2COOH$
(5) $I(CH_2)_3COOH$ (6)

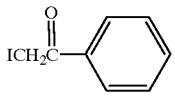

(7)

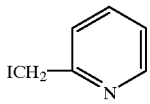

(8)

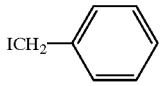

(9) $I(CH_2)_2SO_3Na$
(10) $I(CH_2)_2SO_3CH_3$
(11) $I(CH_2)_2OH$
(12) $I(CH_2)_3OH$
(13) $I(CH_2)_4OH$

(14) $ICH_2CHOH$
$\quad\quad\quad |$
$\quad\quad CH_3$

(15) $ICH_2CHOH$

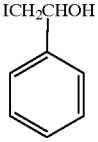

(16) $ICH_2CHCH_2OH$
$\quad\quad\quad |$
$\quad\quad OH$

(17) $ICH_2CHCH_2SO_3Na$
$\quad\quad\quad |$
$\quad\quad OH$ (18)

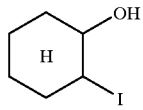

(19) $ICH_2CHCHCH_3$
$\quad\quad\quad | \quad\quad |$
$\quad\quad\quad OH$
$\quad\quad OH$ (20)

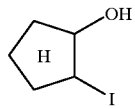

(21) $ICHCOOH$

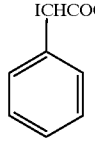

(22) $I(CH_2)_2SO_2CH_2CONH_2$

-continued
(23) $I(CH_2)_2NH_2$
(24) $I(CH_2)_2NHSO_2CH_3$
(25) $I(CH_2)_2NHCOCH_3$
(26) $I(CH_2)_2OCH_3$
(27) $I(CH_2)_2SCH_3$
(28)
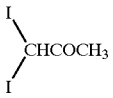
(29)
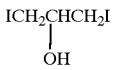
(30) $I(CH_2)_2SO_2NH_2$
(31)
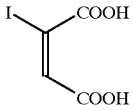
(32)
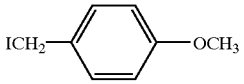
(33)
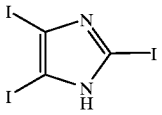
(34)
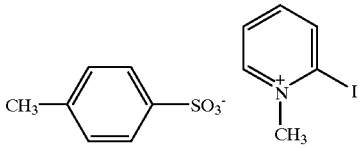
(35)
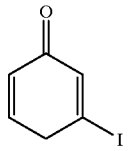
(36)
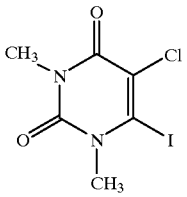
(37)
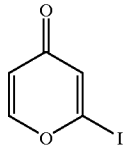
(38)
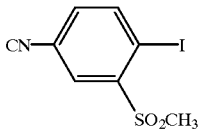
-continued
(39)
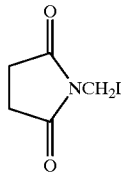
(40)
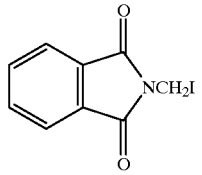
(41)
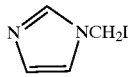
(42)
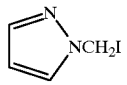
(43)
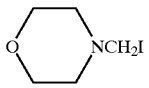
(44)
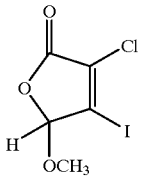
(45) $I(CH_2)_5COOH$
(46)
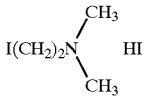
(47) $I(CH_2)_2N(CH_3)SO_2CH_3$
(48) $I(CH_2)_2OCOCH_3$
(49) $I(CH_2)_2N(CH_3)COCH_3$
(50)
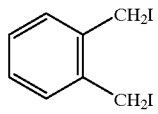
(51)
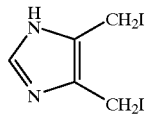
(52)
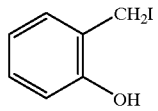

-continued (53)

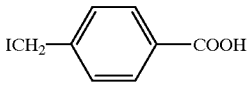

(54)

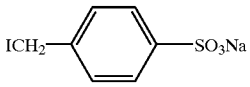

(55) $ICH_2CONH(CH_2)_2—SO_3Na$ (56)

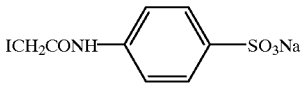

(57)

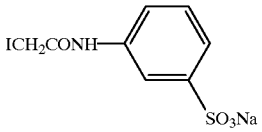

(58)

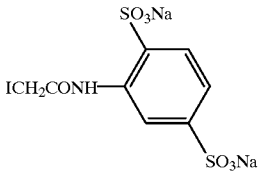

(59)

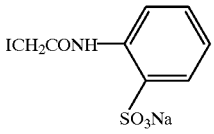

(60)

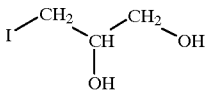

(61)

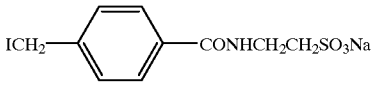

(62)

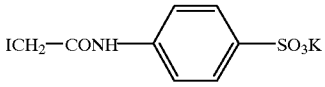

(63)

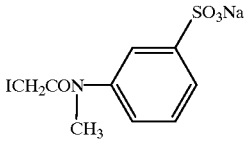

(64)

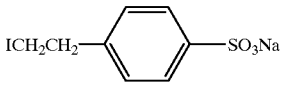

-continued (65)

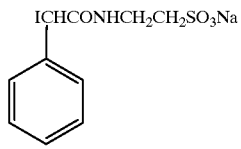

(66)

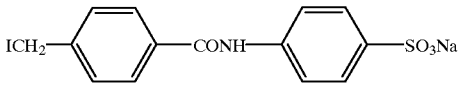

(67)

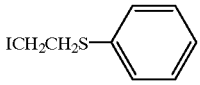

In the preparation of silver halide emulsions are employed compounds affecting grain formation. Defoaming agents used for preventing foaming occurred in stirring adsorb onto the surface of silver halide grains to prevent not only aggregation of grains but also Ostwald ripening to prevent broadening the grain size distribution.

Such defoaming agents or surfactants are useful at the nucleation stage. In cases where such compounds remain still at the growth stage, however, they non-uniformly adsorb onto the silver halide grain surface, resulting in non-uniform grain growth and adversely affecting silver halide grains, such that chemical sensitization is not optimally provided due to non-uniform adsorption of a sensitizer. Accordingly, controlling the remaining amount of such compounds which adversely affects silver halide grains, is indispensable for forming monodisperse tabular grains.

Next, the ultrafiltration used in the invention to optimally remove a solution containing soluble salts from a reaction mixture solution will further be described.

In FIG. 1, a reaction vessel (1) contains a dispersing medium and a silver halide emulsion (3) containing silver halide grains which have been formed via the nucleation process or ripening process. A stirring mechanism (2) to stir the silver halide emulsion, which has blades attached to a rotatable shaft, as shown in FIG. 1, may take any conventional form. A silver salt solution used for crystal growth is added to the reaction vessel through a first silver addition line (4) and simultaneously, a halide salt solution is also added through a second halide addition line (5), while running the stirring mechanism. An addition nozzle can be provided at any position, and is preferably provided so as to add the silver and halide solutions from the bottom of the reaction vessel into the reaction mixture solution.

The volume of the reaction mixture solution contained in the reaction vessel can be adjusted by withdrawing a part of the silver halide emulsion containing a dispersing medium, through solution withdrawing line (8) to ultrafiltration unit (12). In this case, a dispersing medium may further be added according to the reaction conditions. The ultrafiltration unit reduces the volume of the received silver halide emulsion by separating a part of the dispersing medium through permeating solution draining line (10), while silver halide grains are held in the residual silver halide emulsion, called as a residue. The reduced silver halide emulsion, i.e., the residue is returned to the reaction vessel, through solution returning line (9). The ultrafiltration unit (12) comprises plural ultrafiltration modules each having structure capable of employing any ultrafiltration membrane. Any ultrafiltration module can selectively be changed by controlling the valve switch.

Next, a ultrafiltration apparatus and its operation will be further described. The ultrafiltration apparatus has been known as means specifically useful in the preparation of silver halide grains. In the ultrafiltration is generally employed a membrane which allows materials such as soluble salts to be penetrated and allows materials such as silver halide grains not to be penetrated. Such selective separation is conducted by squeezing a solution, by hydraulic pressure, through a synthetic semipermeable membrane which allows only molecules smaller than a specified size to pass and molecules not smaller than the specified size to remain.

The ultrafiltration is preferably conducted in such a manner that a dispersing solution in the reaction vessel is cycled in contact with a semipermeable ultrafiltration membrane so as to produce a pressure difference across the semipermeable ultrafiltration membrane. The membrane permits molecules smaller than a specified size to pass and restricts molecules larger than that, and also silver halide grains within the dispersing solution. Appropriate membranes are selected from those having a molecular weight of 500 to 300,000, and preferably 500 to 50,000. The cut-off molecular weight can readily be changed to the outside of the range described above. As is easily understood, the cut-off molecular weight should be less than the molecular weight of a protective colloid. A specific penetration cut off molecular weight is selected depending on the grain size of silver halide grains and the smallest molecular weight material to be held in the emulsion (also referred to as retentate) at the initial stage of the ultrafiltration. Removal of unwanted materials contained in the emulsion can be controlled by varying the molecular weight cur off using plural ultrafiltration membranes different in molecular weight cut off, during the grain forming process. Employing an apparatus having plural ultrafiltration membranes which are different in molecular weight cut off and arranged in parallel, the ultrafiltration membrane can be changed to another one at any stage of forming silver halide grains.

Pressure of the dispersing solution in contact with the ultrafiltration membrane is broadly variable. Exemplarily, the pressure applied to the reaction vessel in contact with the ultrafiltration membrane is from 100 to 500 palg, and exemplarily 100 palg (7.03 kg/cm$^2$) and the pressure at the outlet of the retentate is from 5 to 10 palg, and exemplarily 10 palg (0.703 kg/cm$^2$) or less. Pressure difference between the inside and outside of the membrane is from 40 to 60 palg (2.81 to 4.22 kg/cm$^2$). The pressure can optionally be varied according to the structure of the reaction vessel and ultrafiltration membrane, viscosity of the dispersing solution, or concentration and desired purity of the residue.

The membrane used in the ultrafiltration has, as an exemplary example, double layer structure comprising a thick, porous layer provided thereon a very thin layer having micropore structure. Usable membranes are various kinds of polymeric materials, including polyvinyl chloride, polyvinyl carboxylate, polyvinyl format, polyvinyl acetate, polyvinyl alcohol, polysulfone, polyvinyl ether, polyacrylamide, polyacrylonitrile, polymethacrylamide, polyimide, polyester, polyfluoroalkylene such as polytetrafluoroethylene or polyfluorovinylidene and cellulose polymers, such as cellulose, cellulose ester (e.g., cellulose acetate, cellulose butyrate).

In the nucleation stage are formed nucleus grains other than tabular nucleus grains (i.e., octahedral grains and singly twinned grains). Prior to the grain growth stage, it is necessary to allow the grains other than tabular grains to be disappeared to obtain monodisperse tabular nucleus grains. To effectuate this, as is well known, Ostwald ripening is conducted subsequently to the nucleation stage. Thus, immediately after nucleation, the pBr is adjusted and thereafter, ripening is carried out by raising the temperature or adding a silver halide solvent until reaching the largest proportion of hexagonal tabular grains. In this event, the gelatin concentration may also be adjusted. The gelatin concentration is preferably 1 to 10% by weight, based on a dispersing medium solution, wherein alkali-processed gelatin is conventionally employed and acid-processed gelatin or phthalated gelatin ia also employed. Gelatin may be added at any time during the ripening stage. Protective colloidal polymers can also be employed in place of gelatin.

The ripening temperature is preferably from 40 to 80° C., and more preferably from 50 to 80° C., and the pBr is preferably from 1.2 to 3.0. A silver halide solvent may be added to allow grains other than tabular grains to be disappeared. Tabular grains alone are thus obtained through ripening.

After completing the ipening stage, grains are further subjected to grain growth. In the growth stage, silver and halide ions are added preferably at a flow rate corresponding to 20 to 100%, and more preferably 30 to 100% of the critical crystal growth rate, wherein silver and halide ions are acceleratedly added.

Preformed fine silver halide grains may be added to a reaction vessel to perform grain growth. Alternatively, fine silver halide grains which have been prepared in a mixer provided outside of the reaction vessel, are immediately added to the reaction vessel, as is disclosed in JP-A 1-183417.

Silver halide grains usable in the invention include regular crystal silver halide grains, such hexahedral, octahedral or decaedral crystal grains and tabular silver halide grains. Tabular grains have advantages such that they have larger surface area per unit volume and therefore can allow a larger amount of a sensitizing dye to adsorb onto the grain surface, leading to enhanced sensitivity. Techniues of tabular silver halide grains are described in JP-A 58-111935, 58-111936, 58-111937, 58-113927 and 59-99433.

Silver halide emulsion used in the invention can be prepared through the process of nucleation, ripening and growth. Nucleation of tabular grains is performed by adding aqueous silver salt and alkalihalide solutions to a reaction vessel containing an aqueous gelatin solution in the double jet precipitation ot by adding an aqueous silver salt solution to an aqueous alkali halide solution in the single jet precipitation. Alternatively, an aqueous alkali halide solution may be added to an aqueous gelatin solution containing a silver salt. Further, as disclosed in JP-A 2-44335, a gelatin solution, a silver salt solution and an alkali halide solution may be added to a mixing vessel and the mixture is immediately transferred to a reaction vessel to form tabular nucleus grains. Furthermore, U.S. Pat. No. 5,104,786 discloses that an aqueoussolution containing alkali halide and a protective colloid is allowed to be flowed through a pipe and a silver salt solution is added thereto to form nucleus grains. In the nucleus grain formation (or nucleation), a protective colloid solution is employed as a dispersing medium and the dispersing medium is formed preferably at a pBr of 1 to 4, and more preferably 1 to 3.5. Examples of the protective colloid include gelatin and protective colloidal polymers. Alkali process gelatin is conventionally employed, and phthalated gelatin, low molecular weight gelatin (molecular weight: 3,000 to 40,000) and oxidized gelatin are also emplyed. Protective collod polymers are exemplarily described in Research Disclosure vol. 76, item No. 17643 (December, 1978).

In the preparation of silver halide emulsions according to the invention, it is preferred that the average intergrain distance, as defined below, is controlled during the time of starting grain gowth to completion thereof:

Average intergrain distance=(Volume of reaction mixture solution/number of growing grains in the reaction mixture solution)$^{1/3}$ The concentration of a protective colloidal polymer is preferably 10% by weight or less, and more preferably 1% by weight or less. The nucleation temperature is preferably 5 to 60° C., and specifically, 5 to 48° C. is preferred to form fine tabular grains of a mean grain size of 0.5 μm or less. The pH of the dispersing medium is preferably 8 or less, and more preferably 6 or less. With respect to the halide composition of an alakli halide solution, the content of iodide in bromide is to be not more than the solid solution limit, and preferably 10 mol % or less.

Silver halide grains may occlude a metal in the interior and/or on the surface by incorporating a metal ion using at least one selected from a cadmium salt, zinc salt, lead salt, thallium salt, iridium salt (including its complex salt), indium salt, rhodium salt (including its complex salt) and iron salt (including its complex salt). Further, reduction sensitization nuclei may be provided in the interior and/or on the surface of the grain by exposing the grains to a reducing atmosphere.

The mean iodide content of silver halide grains used in the invention is preferably 1.0 mol % or less, and more preferably 0.2 to 1.0 mol %. The surface iodide content is higher than the mean iodide content, and the difference in the iodide content between the surface iodide and the mean iodide contents is preferably 1.0 to 5.0 mol %. Herein the surface iodide content refers to an average value of iodide contained in the vicinity of the outermost surface of silver halide grains. The average iodide content in the vicinity of the outermost surface indicates a silver halide phase located in the region of from the surface to a point which X-rays can reach in the measurement of the surface iodide content by the XPS method. Thus, it indicates a region of from the surface to a depth of 50 Å. The intrior iodide content refers to the average iodide content in the region inner than ca. 50 Å from the surface.

In the invention, the average iodide content in the vicinity of the outermost surface indicates a value obtained by measuring a sample which has been cooled to a temperature of −110° C. or lower, by XPS method.

Measurements by the XPS method are conventionally made at an ordinary temperature. However, it was proved that when the iodide content in the vicinity of the outermost surface of silver halide grains is measured at an ordinary temperature by the XPS method, destruction of a silver halide sample due to X-ray irradiation is so marked that the obtained data is not to indicate an accurate value of the iodide content in the vicinity of the outermost surface of the silver halide grains.

It was further proved that in cases of silver halide grains, the halide composition of which is different between the grain surface and interior, such as core-shell type grains and silver halide grains having an outermost surface phase in which a high iodide phase or low iodide phase is localized, the measured value is entirely different from the true value of the composition due to decomposition of silver halide by X-ray exposure and diffusion of the resulting halide ion (specifically, iodide). It was further proved that in order to avoid such destruction of samples and to make accurate and reproducible determination of the iodide content in the vicinity of the outermost surface of the grain, it was better to cool a sample to a temperature of causing no decomposition, i.e., −110° C. or lower.

Procedure of the XPS method employed in the invention is as follows. To an emulsion is added a 0.05% by weight proteinase aqueous solution and stirred at 45° C. for 30 min. to degrade the gelatin. After centrifuging and sedimenting the emulsion grains, the supernatant is removed. Then, distilled water is added thereto and the grains are redispersed. The resulting solution is coated on the mirror-finished surface of a silicon wafer to prepare a sample. Using the thus prepared sample, measurement of the surface iodide was conducte by the XPS method. In order to prevent sample destruction due to X-ray irradiation, the sample was cooled to −110 to −120° C. in a measuring chamber, exposed to X-ray of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. A coefficient of variation of the surface iodide content distribution among grains is preferably 20% or less, and more preferably 5 to 10%.

In the silver halide grain emulsion used in the invention, at least 70% of the total grain projected area is preferably accounted for by tabular grains having an aspect ratio of 3 to 8. More preferably, at least 80% of the total grain projected area is accounted for by tabular grains having an aspect ratio of 4 to 7.

Silver halide grains used in the invention can be chemically sensitized according to the conventional manner. The chemical sensitization method includes sulfur sensitization, selenium sensitization, reduction sensitization, noble metal sensitization with gold or other noble metals, or their combination.

The silver halide grains can be spectrally sensitized to a desired wavelength region using sensitizing dye. The sensitizing dye may be used alone or in combination. A dye having no sensitizing capability or a supersensitizer which has substantially no absorption in the visible light region and promotes spectral sensitization of the sensitizing dye, may be employed in combination with a sensitizing dye.

An antifogging agent or a stabilizer may be incorporated into silver halide emulsions used in the invention. Gelatin is preferably employed as a binder. The emulsionlayer and other hydrophilic colloidal layers may be hardened. A plasticizer, orwater-insoluble or water-soluble synthetic polymer dispersion (or latex) may be incorporated.

EXAMPLES

The present invention is further described based on examples, but embodiments of the invention are by no means limited to these examples.

Example 1

Preparation of Emulsion 1-1 (Comparative example)

A1

| | |
|---|---|
| Ossein gelatin | 75.5 g |
| Polypropyleneoxy-polyethyleneoxy-disuccinate sodium salt (10% ethanol solution) | 6.78 ml |
| Potassium bromide | 64.7 g |
| Water to make | 10800 ml |

-continued

| Preparation of Emulsion 1-1 (Comparative example) | |
|---|---|
| B1 | |
| 0.7 N Silver nitrate aqueous solution | 470 ml |
| C1 | |
| 2.0 N Silver nitrate aqueous solution | 1500 ml |
| D1 | |
| 1.3 N Potassium bromide aqueous solution | 410 ml |
| E1 | |
| 2.0 N Potassium bromide aqueous solution in an amount necessary to control the silver potential as described below | |
| F1 | |
| Ossein gelatin | 125 g |
| Water | 4000 ml |
| G1 | |
| Fine grain emulsion comprised of 3 wt. % gelatin and silver iodide grains (av. size 0.05 μm) | 0.007 mole equivalent |

Preparation of Fine Grainemulsion

To 6.64 liters of an aqueous 5.0 wt % gelatin solution containing 0.06 mol of potassium iodide, 2 liters each of an aqueous solution containing 7.06 mol of silver nitrate and an aqueous solution containing 7.06 mol of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

Nucleation

Using a stirring mixer as shown in FIG. 1, 400 ml of solution B1 and the total amount of solution D1 were added to solution A1 at 55° C. over a period of 40 sec. to form nucleus grains.

Ripening

After completing addition of solutions B1 and D1, solution F1 was added and subsequently, remaining solution B1 was added over a period of 25 min. After adding 30 ml of 10% ammonium nitrate solution, the pH was adjusted to 9.4 with 10% potassium hydroxide solution and ripening was run further over 10 min., then the pH was adjusted to 6.0 with acetic acid.

Growth

To the resulting emulsion were simultaneously added solutions C1 and E1 at a flow rate so as to be consistent with the critical growing rate, while the pAg was maintained at 7.8; when completing addition of 1250 ml of solution C1, solution G1 was concurrently added with solutions C1 and E1. After completing the addition, stirring continued further over 5 min. and the emulsion was desalted in the conventional coagulation process to remove soluble salts. In this emulsion preparation, there was not conducted circulation of the emulsion through withdrawing line 8 (FIG. 1).

Preparation of Emulsion 1-2 (Comparative Example)

Nucleation and ripeining were carried out in the same manner as in Emulsion 1-1. Grain growth was also carried out in a manner similar to Emuslion 1-1, provided that solutions C1 and E1 were added at a flow rate so as to be consistent with the critical growing rate with maintaining the pAg at 7.8, while solution G1 was not added; after completing addition, an iodide ion releasing agent was added; then 1 min. after, an iodide ion release-adjusting agent as shown in Table 1, was added; and stirring continued further for 5 min. The resulting emulsion was desalted in the same manner as in Emulsion 1-1 to obtain Emulsion 1-2.

Preparation of Emulsion 1-3 (Comparative Example)

Nucleation and ripeining were carried out in the same manner as in Emulsion 1-1. Grain growth was also carried out in a manner similar to Emuslion 1-1, provided that after completion of the ripening, using the apparatus as shown in FIG. 1 were concurrently conducted the process of transferring a part of the reaction solution through a circulation line, by means of a circulation pump, to a ultrafiltration unit having a penetration cut off value of 1500 of molecular weight; the process of adding water to the reaction vessel in an amount equivalent the permeation solution to be removed and the process of optionally adding water to the reaction vessel. The circulation was made at a flow rate so that the grain growth was not substantially affected. Further, the reaction solution was so adjusted that the reaction solution at the time of completing addition had the same volume as in Emulsion 1-1. Thereafter, the emulsion was desalted in the same manner as in Emulsion 1-1. The thus-obtained emulsion was denoted as Emulsion 1-3.

Preparation of Emulsion 1-4 (Inventive Example)

Nucleation and ripeining were carried out in the same manner as in Emulsion 1-2. Grain growth was also carried out in a manner similar to Emuslion 1-2, provided that after completion of the ripening, using the apparatus as shown in FIG. 1 were concurrently conducted the process of transferring a part of the reaction solution through a circulation line, by means of a circulation pump, to a ultrafiltration unit having a penetration cut off value of 1500 of molecular weight; the process of adding water to the reaction vessel in an amount equivalent the permeation solution to be removed and the process of optionally adding water to the reaction vessel. The circulation was made at a flow rate so that the grain growth was not substantially affected. Further, the reaction solution was so adjusted that the reaction solution at the time of completing addition had the same volume as in Emulsion 1-1. After completing addition, an iodide ion releasing agent and an iodide ion release-adjusting agent were added as shown in Table 1. Thereafter, the emulsion was desalted in the same manner as in Emulsion 1-1, The iodide ion release-adjusting agent includes bases and nucleophilic agents, while transferring a portion of the reaction solution through a circulation line to a ultrafiltration unit to remove soluble salts. The thus-obtained emulsion was denoted as Emulsion 1-4.

Preparation of Emulsions 1-5 to 1-7 (Inventive Example)

Emulsions 1-5 to 1-7 each were prepared in the same manner as in Emulsion 1-4, provided that an iodide ion releasing agent and an iodide ion release-adjusting agent were added, as shown in Table 1.

Emulsions 1-1 to 1-7 each were electron-microscopically observed with respect to a mean grain thickness and a mean grain diameter, based on the grain projected area (i.e., equivalent circular diameter, denoted as "ECD") of silver halide grains. The surface iodide content of the grains was also measured. Observed values including a coefficient of variation (denoted as "VC") are summarized in Table 2.

TABLE 1

| Emul-sion | Ultra-filtration | Iodide Introducing Method | Iodide Ion Iodide Ion Releasing Agent Compd. | Iodide Ion Iodide Ion Releasing Agent Amount (g) | Release-adjusting Agent Compd. | Release-adjusting Agent Amount (g) | Remark |
|---|---|---|---|---|---|---|---|
| 1-1 | No. | AgI fine grains | — | — | — | — | Comp. |
| 1-2 | No. | Iodide ion releasing | (56) | 9.2 | $Na_2SO_3$ | 3.63 | Comp. |
| 1-3 | Yes | AgI fine grains | — | — | — | — | Comp. |
| 1-4 | Yes | Iodide ion releasing | (56) | 9.2 | $Na_2SO_3$ | 3.63 | Inv. |
| 1-5 | Yes | Iodide ion releasing | (56) | 9.2 | KOH | 4.22 | Inv. |
| 1-6 | Yes | Iodide ion releasing | (29) | 4.1 | $Na_2SO_3$ | 3.63 | Inv. |
| 1-7 | Yes | Iodide ion releasing | (29) | 4.1 | KOH | 4.22 | Inv. |

TABLE 2

| Emul-sion | Mean grain thickness (μm) | Mean Grain Diameter (μm) | VC of Thickness (%) | VC of Diameter (%) | Mean Iodide (mol %) | Surface Iodide (mol %) | VC of Surface Iodide | Remark |
|---|---|---|---|---|---|---|---|---|
| 1-1 | 0.20 | 0.80 | 35 | 21 | 0.3 | 1.4 | 38 | Comp. |
| 1-2 | 0.19 | 0.82 | 32 | 21 | 0.3 | 1.3 | 33 | Comp. |
| 1-3 | 0.20 | 0.80 | 23 | 16 | 0.3 | 1.4 | 37 | Comp. |
| 1-4 | 0.19 | 0.82 | 20 | 14 | 0.3 | 1.5 | 16 | Inv. |
| 1-5 | 0.19 | 0.82 | 20 | 14 | 0.3 | 1.6 | 17 | Inv. |
| 1-6 | 0.19 | 0.82 | 20 | 14 | 0.2 | 1.2 | 18 | Inv. |
| 1-7 | 0.19 | 0.82 | 20 | 14 | 0.2 | 1.0 | 18 | Inv. |

As apparant from the results, it is shown that emulsions comprised of silver halide grains exhibiting a smaller variation coefficient of grain diameter or grain thickness and a narrower distribution of the surface iodide content among grains were obtained according to the present invention.

Emulsions 1-1 to 1-7 each were subjected to the following sensitization. Thus, after dividing each emulsion to a given amount and heating the emulsion to a temperature of 55° C., 0.1 mol % of fine silver iodide grains, 100 mg of 4-hydroxy-6-methyl-1,3,3a,7-tetrazaindene (TAI) and solid particle dispersions of 445 mg of spectral sensitizing Dye 1 and 5 mg of Dye 2 were added thereto. Subsequently, 15 mg of sodium thiosulfate, 105 mg of ammonium thiocyanate and 12.5 mg of chloroauric acid were further added and ripening was carried out over a total period of 2 hrs.

Dye 1: anhydro-5,5'-dichloro-9-ethyl-3,3'-di-(sulfopropyl) oxacarbocyanine hydroxide Dye 2: anhydro-5,5'-dibutoxycarbonyl-1,1'-diethyl-3,3'-di-(sulfobutyl)benzimidazolocarbocyanine sodium salt When completing ripening, 5 mg of 1-phenyl-5-mercaptotetrazole (PMA) and 200 mg of TAI were added as a stabilizer. The amots described above each are per mol of silver.

The solid particle dispersion was obtained by adding a given amount of the spectral sensitizing dye to water maintained at 27° C. and stirring over a period of 30 to 120 min. by means of a high-speed stirrer (dissolver) at a speed of 3,500 rpm.

A selenium sensitizer dispersion was prepared in the following manner. Triphenylphosphine selenide of 120 g was added into 30 kg of ethyl acetate at 50° C. and dissolver with stirring. Gelatin of 3.8 kg was dissolved in 38 kg water and 93 g of an aqueous solution of 25 wt % sodium dodecylbebzene-sulfonate was added thereto. Then, both solutions were mixed and dispersed over a period of 30 min. at a temperature of not higher than 50° C. by means of a high-speed stirring type disperser having a dissolver of a diamerter of 10 cm, at a blade-rotating speed of 40 m/sec. Thereafter, stirring continued under reduced pressure with stirring to remove ethyl acetate until reached the concentration of remaining ethyl acetate of 0.3 wt % or less. Then, the dispersion was diluted with water to make it 80 kg. A part of the dispersion was employed.

To each of the resulting emulsions, additives as shown below were added to prepare an emulsion coating solution. A coating solution for a protective layer was also prepared. Samples 1 to 12 were prepared by coating both coating solutions on both sides of a support using two slide hopper type coating machines so as to have 1.6 g/m$^2$ of silver coverage and 2.5 g/m$^2$ of a gelatin coating amount of each side. The support was a polyethylene terephthalate base with a thickness of 175 μm (tinted with a blue density of 0.13 and used for X-ray film) which was subbed by coating an aqueous dispersion of a copolymer latex comprised of monomers of glycidyl methacrylate (50 wt. %), methyl acrylate (10 wt. %) and butyl methacylate (40 wt. %).

Additives used in coating solutions are as follows, wherein the amount is based on mol of silver halide.

1st Layer (Cross-over Light Shielding Layer)

| | |
|---|---|
| Solid fine particle dispersion of dye (AH) | 180 mg/m$^2$ |
| Gelatin | 0.2 g/m$^2$ |
| Sodium dodecylbenzene sulfonate | 5 mg/m$^2$ |

-continued

| | |
|---|---|
| Compound (I) | 5 mg/m$^2$ |
| Sodium 2,4-dichloro-6-hydroxy-1,3,5-triazine | 5 mg/m$^2$ |
| Colloidal silica (av. size of 0.014 $\mu$m) | 10 mg/m$^2$ |

2nd Layer (Emulsion Layer)

To the emulsions prepared as above were added the following additives.

| | |
|---|---|
| Compound (G) | 0.5 mg/m$^2$ |
| 2,6-Bis(hydroxyamino)-4-diethylamino-1,3,5-triazine | 5 mg/m$^2$ |
| t-Butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Poly(sodium styrenesulfonate) | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica | 0.5 mg/m$^2$ |
| Latex (L) | 0.2 g/m$^2$ |
| Dextrin (mean MW of 1,000) | 0.2 g/m$^2$ |
| Dextran (mean MW of 40,000) | 0.2 g/m$^2$ |
| Gelatin | 1.2 g/m$^2$ |

3rd Layer (Protective Layer)

| | |
|---|---|
| Gelatin | 0.8 g/m$^2$ |
| Matting agent comprising polymethyl methacrylate (having an area average particle-size of 7 $\mu$m) | 50 mg/m$^2$ |
| Formaldehyde | 20 mg/m$^2$ |
| Sodium 2,4-dichloro-6-hydroxy-1,3,5-triazine | 10 mg/m$^2$ |
| Bis-vinylsulfonylmethyl ether | 36 mg/m$^2$ |
| Latex (L) | 0.2 mg/m$^2$ |
| Polyacrylamide (mean M.W of 10,000) | 0.1 mg/m$^2$ |
| Poly(sodium acrylate) | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}0(CH_2CH_2O)_{11}H$ | 3 mg/m$^2$ |
| $C_8F_{17}SO_2N(C_3H_7)$ $(CH_2CH_2O)_{15}H$ | 2 mg/m$^2$ |
| $C_8F_{17}SO_2N(C_3H_7)$ $(CH_2CH_2O)_4(CH_2)_4SONa$ | 1 mg/m$^2$ |

Latex (1)

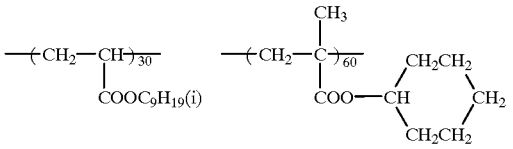

-continued

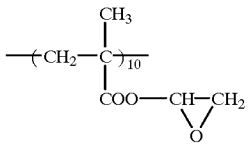

Compound (I)

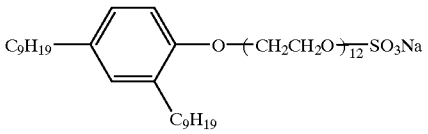

Compound (G)

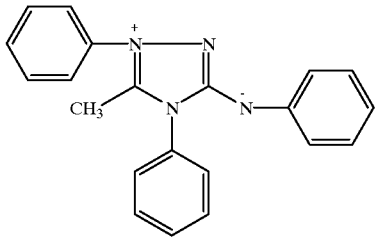

Compound (H)

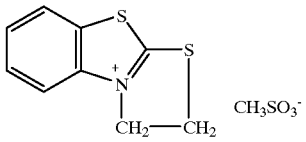

Compound (AH)

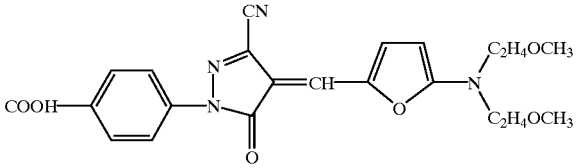

Compound (M)

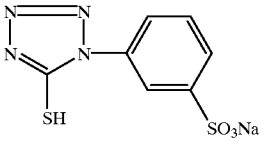

Compound (N)

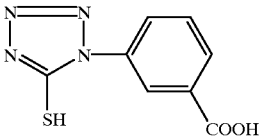

Compound (J)

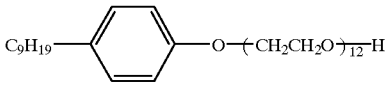

Compound (SI)

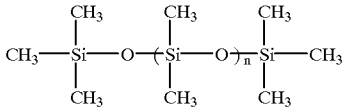

n ≒ ~1000

-continued

Compound (S-1)

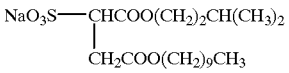

Compound (K)

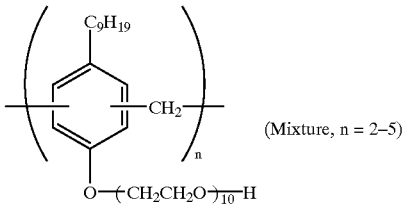

Compound (O)

$C_{11}H_{23}CONH(CH_2CH_2O)_5H$

Compound (S-2)

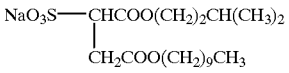

The obtained photographic material samples were evaluated with respect to photographic performance. Samples each were sandwiched between radiographic intensifying screens SRO-250 (available from Konica Corp.), exposed, through an aluminum wedge, to X-rays at a bulb voltage of 80 kVp and bi¥ulb current of 100 mA for a period of 0.05 sec. and processed using an automatic processor, SRX-501 (available from Konica Corp.), over a total time (dry to dry) of 30 sec.

Samples each were measured with respect to photographic characteristics (fog density, sensitivity, gamma and Dm). Sensitivity was shown as a relative value of reciprocal of exposure necessary to give a density of fog plus 1.0, based on the sensitivity of sample 1 being 100. Fog is an optical density of an unexposed portion including a support; Dm is a maximum density; and gamma is a slope of a line connecting logarithmic exposures that gives densities of 1.0 and 2.0. shown in Table 3.

TABLE 3

| Sample | Emulsion | Fog | Sensitivity | Gamma | Dm | Remark |
|---|---|---|---|---|---|---|
| 1 | 1-1 | 0.22 | 100 | 2.5 | 3.3 | Comp. |
| 2 | 1-2 | 0.21 | 100 | 2.5 | 3.3 | Comp. |
| 3 | 1-3 | 0.21 | 100 | 2.5 | 3.3 | Comp. |
| 4 | 1-4 | 0.15 | 105 | 2.8 | 3.3 | Inv. |
| 5 | 1-5 | 0.16 | 105 | 2.7 | 3.3 | Inv. |
| 6 | 1-6 | 0.16 | 100 | 2.7 | 3.3 | Inv. |
| 7 | 1-7 | 0.16 | 100 | 2.7 | 3.3 | Inv. |

As apparent from Table 3, it was proved that photographic material samples according to the invention exhibited low fog, high sensitivity and high contrast.

What is claimed is:

1. A method for the preparation of a silver halide emulsion comprising:

(a) reacting a silver salt solution and a halide salt solution to perform silver halide grain nucleation, followed by silver halide grain growth to form silver halide grains in the presence of an iodide ion releasing agent, and (b) subjecting a reaction mixture solution to ultrafiltration during grain growth, said iodide ion releasing agent being represented by R—I Formula (1)

wherein R represents a univalent organic residue capable of releasing an iodide ion upon reaction with a base or a nucleophilic agent; and an iodide ion release-adjusting agent being present with the iodide ion releasing agent, wherein said iodide ion releasing agent and said iodide ion release-adjusting agent are introduced at a time during the grain growth.

2. A method for the preparation of a silver halide emulsion comprising:

(a) reacting a silver salt solution and a halide salt solution to perform silver halide grain nucleation, followed by silver halide grain growth to form silver halide grains in the presence of an iodide ion releasing agent, and (b) subjecting a reaction mixture solution to ultrafiltration during grain growth, said iodide ion releasing agent being represented by R—I Formula (1)

wherein R represents a univalent organic residue capable of releasing an iodide ion upon reaction with a base or a nucleophilic agent; and an iodide ion release-adjusting agent being present with the iodide ion releasing agent, wherein said iodide ion releasing agent and said iodide ion release-adjusting agent are introduced at the time of completing the grain growth.

* * * * *